US006016572A

United States Patent [19]

Park

[11] Patent Number: 6,016,572

[45] Date of Patent: Jan. 25, 2000

[54] FREE-SIZE CAP

[75] Inventor: Boo Yl Park, Seoul, Rep. of Korea

[73] Assignee: Dada Corp., Seoul, Rep. of Korea

[21] Appl. No.: 09/217,997

[22] Filed: Dec. 22, 1998

[51] Int. Cl.[7] ..... A42B 1/22

[52] U.S. Cl. ..... 2/195.2; 2/181; 2/195.1; 2/175.1

[58] Field of Search ..... 2/181, 195.1, 195.2, 2/195.3, 183, 175.1, 417, 418

[56] References Cited

U.S. PATENT DOCUMENTS

| | | | |
|---|---|---|---|
| 2,106,075 | 1/1938 | Tabley | 2/181 |
| 2,810,913 | 10/1957 | Kennedy | 2/195.3 |
| 3,321,774 | 5/1967 | Tames | 2/181 |
| 4,023,212 | 5/1977 | Huffman | 2/197 |
| 4,141,229 | 2/1979 | Sharpe | 66/171 |
| 4,165,542 | 8/1979 | McLaughlin | 2/209.1 |
| 4,378,606 | 4/1983 | Snowden | 2/198 |
| 4,393,519 | 7/1983 | Nicastro | 2/12 |
| 4,491,985 | 1/1985 | Dalton | 2/171 |
| 4,551,859 | 11/1985 | Gerhardt | 2/172 |
| 4,608,721 | 9/1986 | Lipkin | 2/172 |
| 4,642,817 | 2/1987 | Ferstenfeld | 2/183 |
| 4,662,007 | 5/1987 | Lipkin | 2/195 |
| 4,845,782 | 7/1989 | Gregg | 2/172 |
| 5,012,532 | 5/1991 | Krystal | 2/197 |
| 5,070,545 | 12/1991 | Tapia | 2/195 |
| 5,119,514 | 6/1992 | Woehl | 2/195 |
| 5,153,939 | 10/1992 | Howe et al. | 2/69 |
| 5,161,260 | 11/1992 | Reynolds | 2/207 |
| 5,272,772 | 12/1993 | Hahn | 2/195.2 |
| 5,428,843 | 7/1995 | Clowers et al. | 2/195.2 |
| 5,481,759 | 1/1996 | Rinaldi | 2/195.1 |
| 5,715,540 | 2/1998 | Cho | 2/195.3 |
| 5,862,522 | 1/1999 | Cho | 2/195.1 |
| 5,907,871 | 6/1999 | Austin | 2/181 |

*Primary Examiner*—Diana Oleksa

*Attorney, Agent, or Firm*—Jacobson, Price, Holman & Stern, PLLC

[57] ABSTRACT

A free-size cap is capable of fitting wearers having a range of head sizes. The cap includes a multi-gore shell forming a crown portion and flexible seams therebetween. Ones of the gores and flexible seams forming the multi-gore shell are composed of a biaxially stretchable woven, or knitted, material. In addition, an elastic headband also is adapted to accommodate a variety of sizes of heads. The structure permits a cap to be designed which is produced easily, attractive in use or other time by keeping the shape, comfortable for the wearer by causing no oppression, and further provides the advantageous feature of multiple size capability.

24 Claims, 6 Drawing Sheets

FREE-SIZE CAP

FIELD OF THE INVENTION

The present invention relates generally to an improved cap structure, and more particularly to an improved free-size cap having a typical baseball configuration, and with one cap being adapted to accommodate a variety of sizes of heads.

BACKGROUND OF THE INVENTION

It shall be understood that caps of the baseball cap style are marketed in a variety of ways. These caps are marketed through conventional retail outlets, and have also found a substantial market as promotional items. In the marketing of outer wear products, it is, of course, more economical to provide such products with a minimal numbers of sizes. Thus, economy of numbers may be achieved through utilization of caps of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the free-size caps become extremely desirable for the customer.

As is conventional, baseball caps employ a crown portion to which a visor is secured to the forward edge of the crown and extends outwardly therefrom.

In utilization of caps for outer wear, it is desirable for the forward portion to be somewhat rigid so that, for appearance purposes, the crown portion stands somewhat erect. Also such an arrangement will normally provide a means for the visor portion to be rigid, durable, and extend generally forwardly of the wearer's forehead. Accordingly, the front gores or panels may be fitted and/or stiffened by suitable means in order to stand generally erect during wear.

In the past, attempts have been made to provide free-size cap structures of the baseball cap style, and such caps are in wide-spread use today. Typically, free-size caps are created through the utilization of a variable-length snap arrangement which permits the user to adjust the cap size as required. Such caps are frequently of the single or fixed size variety.

More recently, attempts have been made to provide free-size cap of the baseball cap type or style which do not utilize a variable-length snap arrangement. An example of such a cap is disclosed in U.S. Pat. No. 5,715,540 to B. W. Cho. In the Cho patent, a free-size cap comprises a main body having a plurality of gores forming a crown portion having a lower peripheral edge wherein at least some of the plurality of gores are composed of uniaxially stretchable fabric aligned to stretch only in a peripheral direction; and a sweat band connected to the lower peripheral edge of the crown portion, said sweat band being a single unfolded stretchable sheet in structure such as an elastic band so that it is adjustable together with the main body to fit various head sizes.

However, such caps cause a sense of oppression to the wearers since it uses a high elastic sweat band and does not keep its shape when not in use.

It is desirable to provide a cap which is more simply produced, attractive in use, comfortable for the wear by causing no oppression, and further provides the advantageous feature of multiple size capability.

Such cap designs are utilized by individuals for a variety of outdoor purposes, including work purposes as well as sport purposes, including such sports as hunting, fishing, and the like.

SUMMARY OF THE INVENTION

Therefore, it is a primary object of the present invention to provide an improved baseball-type cap for fitting multiple sizes which includes flexible seams connecting the respective panels along longitudinal line.

It is a further object of the present invention to provide a baseball-type cap structure capable of multi-size use, which can be manufactured easily utilizing conventional materials and fabrics, and which is both functional and attractive in its use and appearance.

It is yet a further object of the present invention to provide an improved free-size cap structure of the baseball-type cap, which employs biaxially, or uniaxially, elongated Knitted fabric or stretchable woven fabric for bias tapes which connect each panels, thereby avoiding the oppressions to the wearers' forehead as well as diminishing the manufacturing process.

It is still a further object of the present invention to decrease the quantity of stock in a manufactory or in a selling agency due to the wider accommodation range of the cap.

In order to achieve the foregoing objects, the present invention provides a free size cap comprising a main body having a plurality of gores forming a crown portion having a lower peripheral edge, wherein at least some of said plurality of gores are connected by stretchable material aligned to stretch at least in the peripheral direction so that the material functions as flexible seam, lower peripheral portion of said crown portion being folded inwardly so that it works as a headband and a sweat band attached to said lower peripheral edge of said crown portion to which a visor is attached, said sweat band being a non-stretchable material having a width larger than a sewing margin of the visor but less than the width of the normal headband.

In accordance with another aspect of the present invention, a free-size cap comprising a main body having a plurality of gores forming a crown portion having a lower peripheral edge, wherein at least some of said plurality of gores are connected by a stretchable material aligned to stretch at least in the peripheral direction so that the material function as flexible seam; and a sweat band connected to said lower peripheral edge of said crown portion, said sweat band being a single unfolded stretchable material is provided.

Due to the adoption of flexible seams, the problem in the prior art is improved that the height of crown is lowered as the circumference become wider.

In addition, by making the color of the flexible seams different from the crown, aesthetical appeal is advanced.

Other and further objects of the present invention will become apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

BRIEF DESCRIPTION OF THE DRAWINGS

FIG. 2-1 is an enlarged view of the portion A in FIG. 2;

DESCRIPTION OF THE PREFERRED EMBODIMENT

Figure 1:
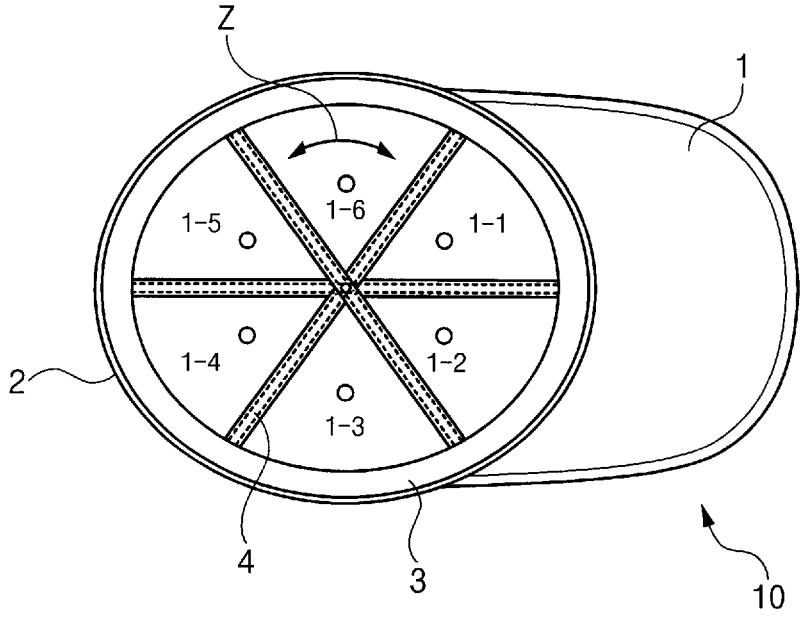
FIG. 1 is a bottom view of the free-size cap showing the interior of the crown portion of the free-size cap of the present invention.
Figure 2:
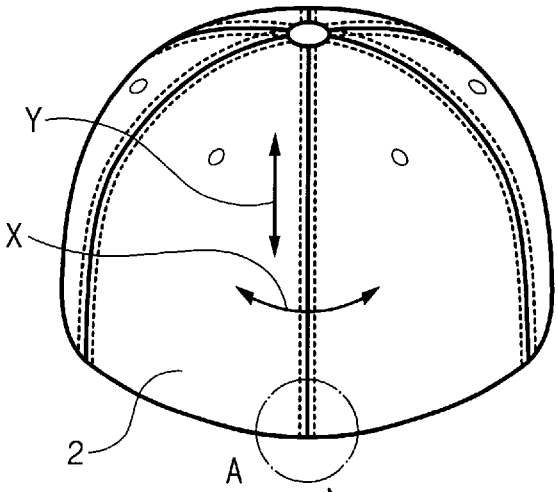
FIG. 2 is a rear view of the free-size cap.
Figures 1, 2:
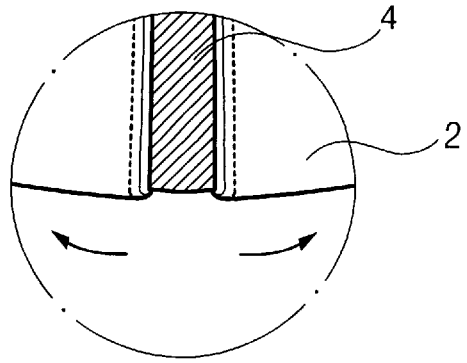

In accordance with the preferred embodiment of the present invention, and with the particular attention directed to FIGS. 1 and 2, a free-size cap structure generally desginated by 10 includes a crown 2 which is fabricated with several fabric segments(panels or gores) 1-1, 1-2, 1-3, 1-4, 1-5 and 1-6. Secured to the front portion of the crown is a visor 1 extending away from the crown 2 at a desirable angle or tilt. The visor, as previously indicated, is normally somewhat rigid, and hence is not stretchable.

A crown 2 is formed of individual gores such as gores 1-1. 1-2, 1-3, 1-4, 1-5, and 1-6, which fabricated with the normal woven fabric or stretchable fabric. Generally it is known that the normal woven fabric is not stretchable, however, the above is stretchable when it is cut in bias direction.

In the present invention, as the most distinguishable feature, each gores, at least gore 1-3 and 1-4, 1-4 and 1-5, and 1-5 and or 1-6 are connected by biaxially, or or uniaxially, stretchable knitted or woven fabric tape which functions as the flexible seams 4. The tape may be sewn at 5 with the gores in a manner shown in FIG. 3. Any other way of connecting the gores and the tape could be used as long as the each side of tape is secured firmly at the each side of the gores, and each adjacent side of the gores are not attached together so that the tape 4 is able to function as the flexible seam. The width of the tape 4 is not limited to a certain length. The color of the tape may be matched to the color of the gores. However, it is still possible to adopt the tape of different color so that it appears as a contrast piping. Since the visor 1 is rigid and not stretchable, gores 1-1 and 1-2, gores 1-2 and 1-3, and gores 1-1 and 1-6 are not necessarily connected by the stretchable tape. Those seams may be sewn together in a conventional way.

The lower peripheral edge 6 of the crown 2 may be finished with an elastic headband 3 in a conventional way.

The headband 3 is fabricated with material capable of absorbing the sweat or the like and of providing the elasticity.

FIG. 2-1 illustrates the enlarged portion of the flexible seam when the cap 10 is in use.

Figure 3:
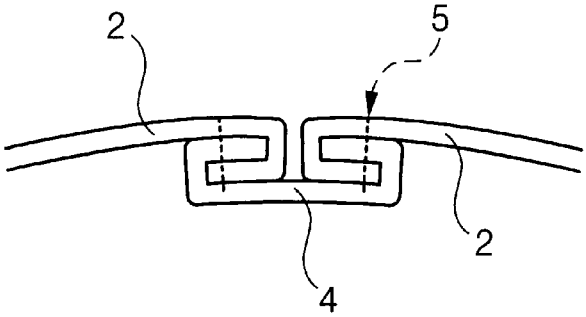
FIG. 3 is an enlarged cross-sectional view of the portion in which the panels and the flexible tape are sewn together.

FIG. 3 shows a cross-sectional view of the portion in which the panel and the flexible seam are sewn together.

Figure 4:
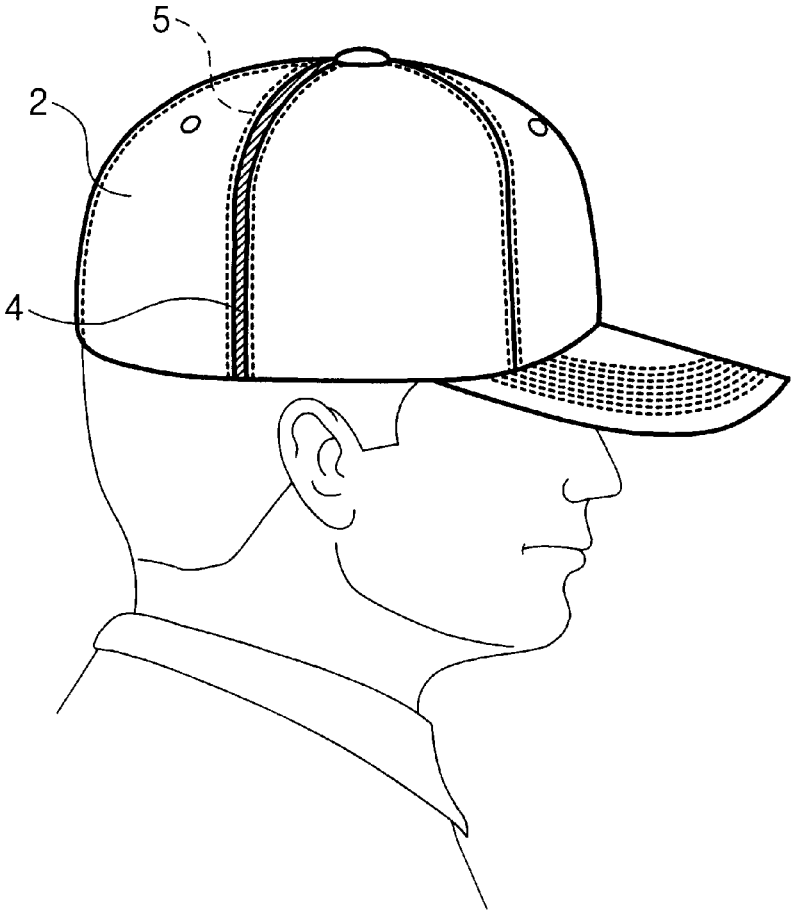
FIG. 4 is an elevational view of the cap when in use.

FIG. 4 shows the side view of the crown 2, the flexible seam 4 disposed between the gores.

Figure 5:
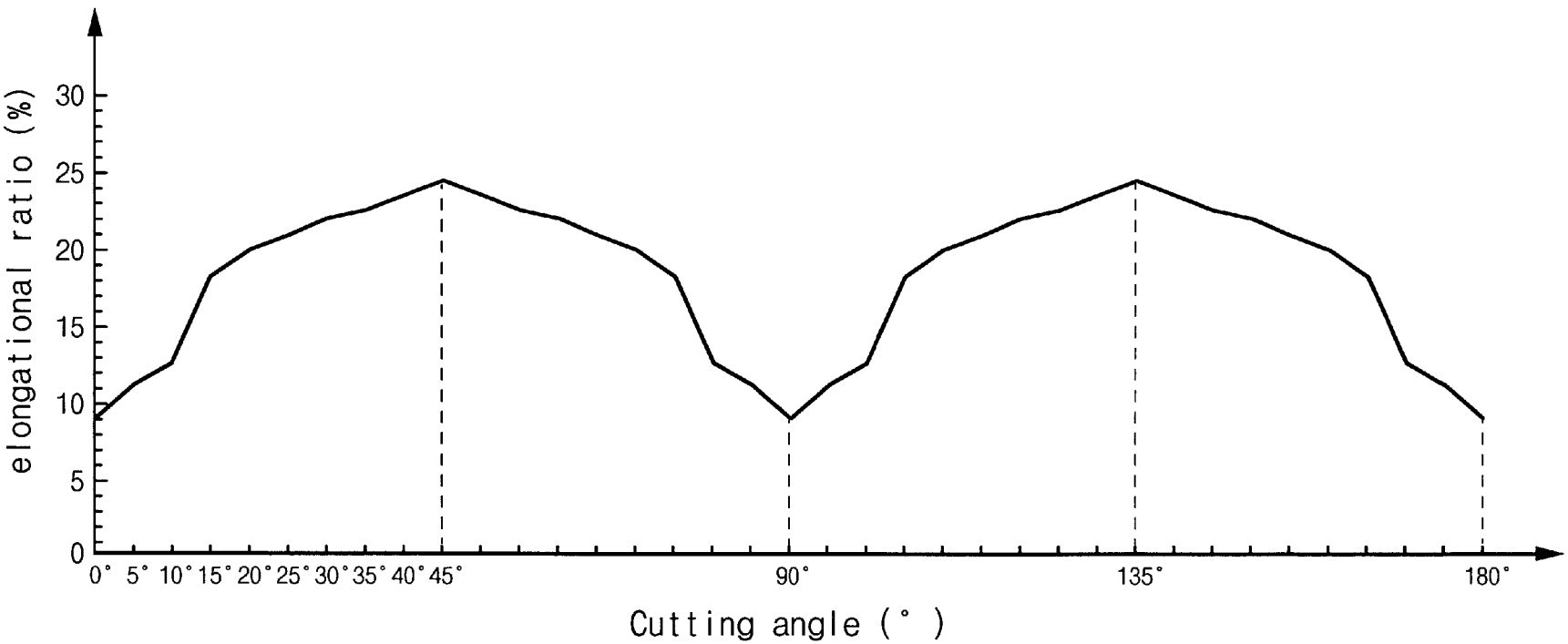
FIG. 5 is a graph showing the relation between the cutting angle of the fabric and elongational ratio.
Figure 6:
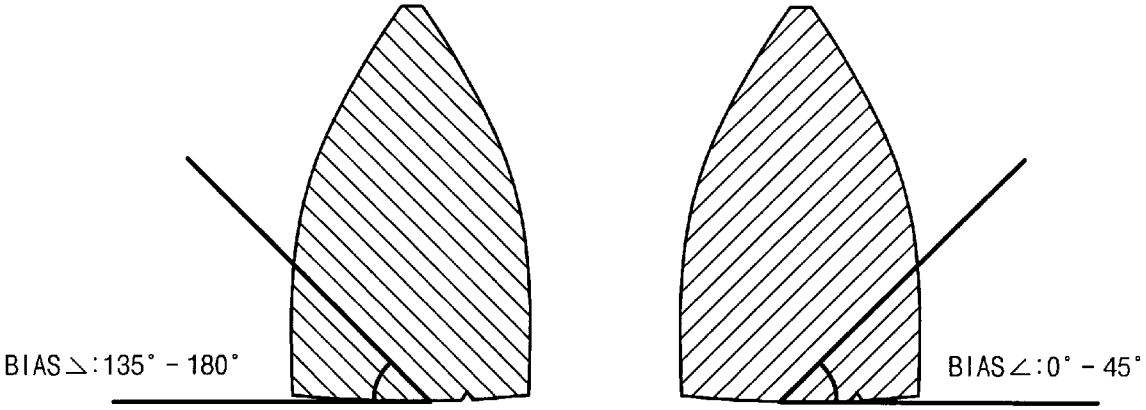
FIG. 6 illustrates the cutting angle of the panel fabric.
Figure 7:
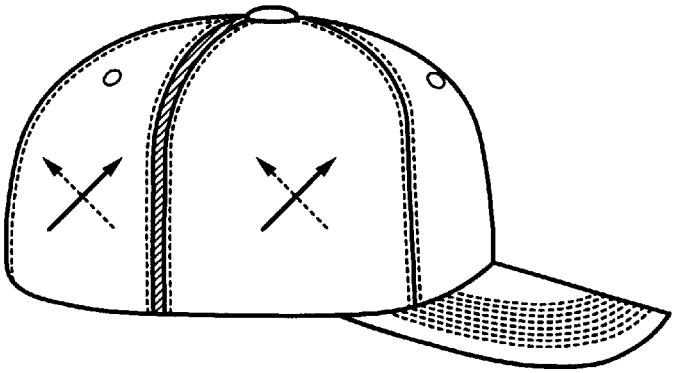
FIG. 7 illustrates the elongational direction of the respective panel.

FIG. 5 shows the relation between the cutting angle of the fabric and elongational ratio. As is clear from FIG. 5, the fabric (twill fabric) shows about 25% elongation at the cutting angle of 45° or 135°. Accordingly, in the present invention, it is preferable to use normal woven fabric which is cut in a bias direction. In the present invention, however, the woven fabric which is cut in a regular direction is still usable. Uniaxially or biaxially stretchable fabric is usable for gores as well.

Figure 8:
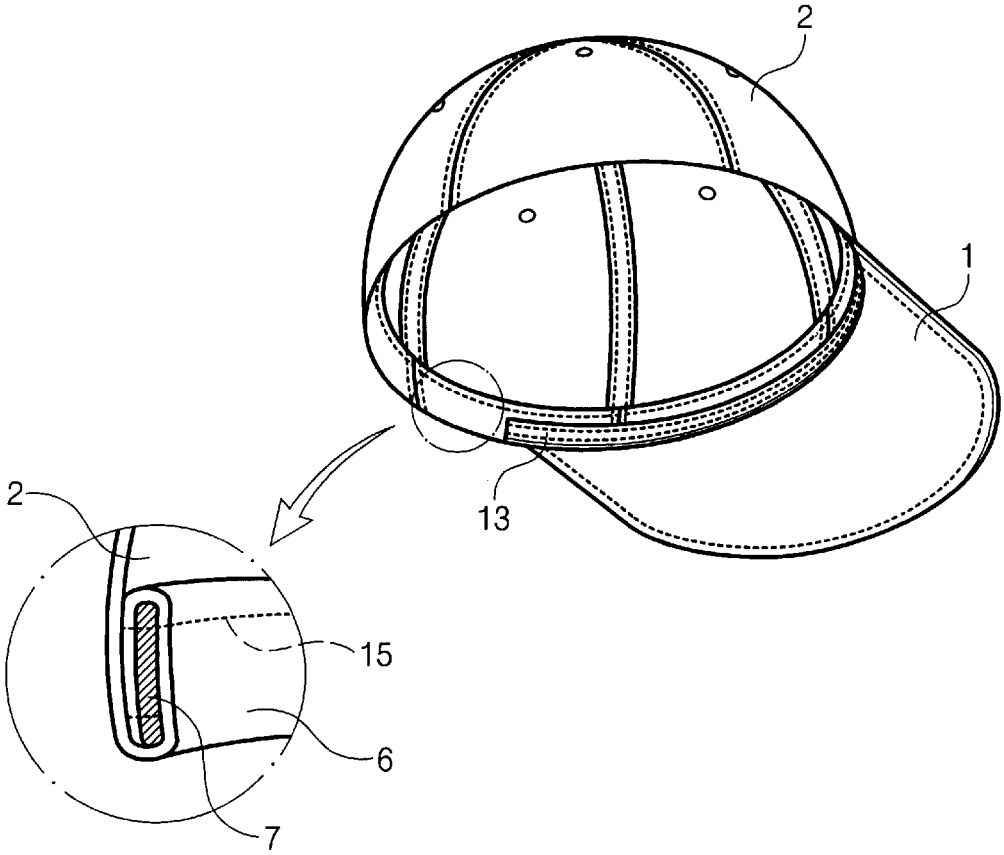
FIG. 8 is an alternative preferred embodiment of the present invention showing the double-folded portion of the crown.
Figure 9:
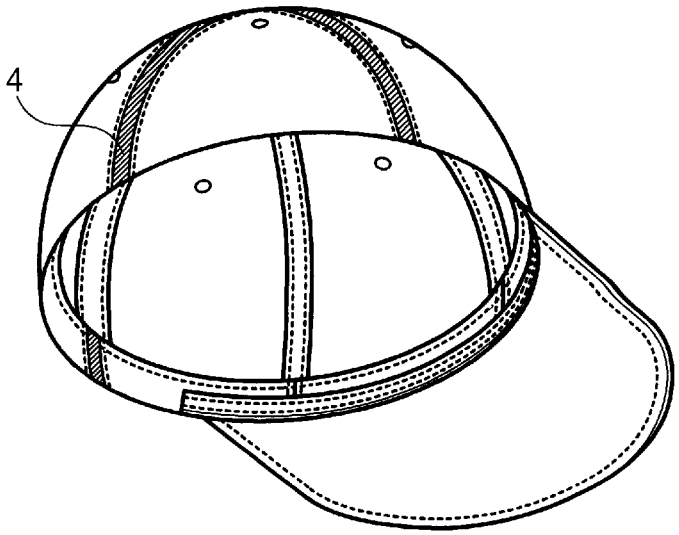
FIG. 9 is a perspective view of FIG. 8 showing the elongated bias tapes.
Figure 10:
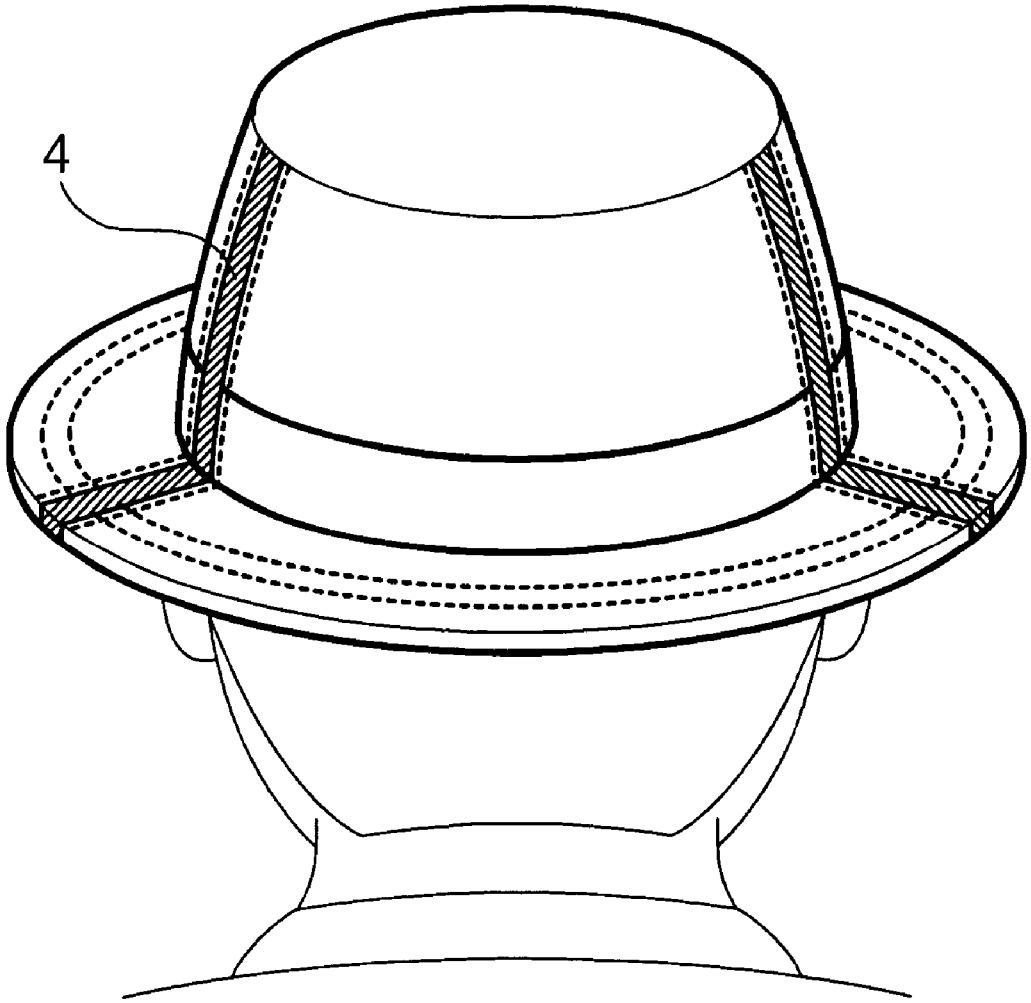
FIG. 10 is an alternative preferred embodiment of the present invention applied to a hat or trilby.

Referring to FIG. 8 and FIG. 9, as an alternative preferred embodiment, the lower peripheral edge 6 extended from the crown 2 may be inwardly folded once, twice or more times around the crown 2 by the width of the normal headband. In order to provide rigidity with the folded lower peripheral portion 6, the flexible material like a sponge 7 may be accompanied therein. The sponge may be attached to the fabric by sewing with the thread 15. Since the folded peripheral portion of the crown is working as the headband in the present invention, an additional sweat band is not necessary to be attached around the lower peripheral of the gores 1-1, 1-2, 1-3, 1-4, 1-5 and 1-6. In this preferred embodiment, however, the visor 1 is attached to the lower peripheral portion of the gores 1-1 and 1-2, a sweat band formed of any suitable material may be attached on that area. Since the visor 1 is rigid and non-stretchable, the sweat band 13 is not necessary to be stretchable. Instead, the sweat band 13 is fabricated with the material capable of absorbing sweat or the like. The sweat band is attached on the sewing margin of the visor so that the margin is not visible from the outside. Accordingly, the width of the sweat band used in the present invention may be larger than the width of the sewing margin of the visor but less than the width of the headband normally used.

It is preferable that the length of the sweatband is a little bit longer than the peripheral length of the visor 1 so that it covers the sewing margin of the visor 1.

It shall be noted that even though the invention is described only for a baseball-type cap in the above stated embodiments, the technical concept of the present invention is also applicable to any other head wears like a hat or a trilby.

Furthermore it will be appreciated that various modifications of the present invention may be undertaken by those skilled in the art without departing from the spirit and scope hereof.

We claim:

1. A free-size cap comprising:

a main body having a plurality of gores forming a crown portion with a lower peripheral edge, wherein at least some of said plurality of gores are connected to each other by stretchable material aligned to stretch at least in a peripheral direction to form a flexible seam; a portion of the lower peripheral edge being folded inwardly to form a headband; and a sweat band attached to said lower peripheral edge of said crown portion along a segment of said lower peripheral edge at which a visor is attached, said sweat band being a non-stretchable material having a width less than a width of the headband, and having a length longer than a peripheral length of said visor.

2. The free-size cap as claimed in claim 1, wherein said gores are fabricated by a fabric in sheet structure.

3. The free-size cap as claimed in claim 2, wherein said fabrics is cut in a bias direction.

4. The free-size cap as claimed in claim 1, wherein said gores are fabricated by stretchable fabric.

5. The free-size cap as claimed in claim 1, wherein said stretchable material is fabricated of biaxially stretchable fabric.

6. The free-size cap as claimed in claim 1, wherein a flexible material is accompanied in said folded portion of the lower peripheral edge.

7. The free-size cap as claimed in claim 6, wherein said flexible material is a sponge.

8. A free-size cap comprising:

a main body having a plurality of gores forming a crown portion with a lower peripheral edge, wherein at least some of said plurality of gores are connected to each other by a stretchable material aligned to stretch at least in a peripheral direction to form a flexible seam; and a sweat band connected to said lower peripheral edge of said crown portion, said sweat band being a single unfolded material, wherein the flexible seam is formed along an entire length of the at least one gore.

9. The free-size cap as claimed in claim 8, wherein said single unfolded material is an elastic band.

10. The free-size cap as claimed in claim 8, wherein said gores are fabricated by a fabric in sheet structure.

11. The free-size cap as claimed in claim 10, wherein said fabric is cut in a bias direction.

12. A headwear comprising:

a main body having a plurality of gores forming a crown portion with a lower peripheral edge, wherein at least some of said plurality of gores are connected by stretchable material aligned to stretch at least in a peripheral direction to form a flexible seam; and a sweat band connected to said lower peripheral edge of said crown portion, said sweat band being a single unfolded material, wherein the flexible seam is formed along an entire length of the at least one gore.

13. The free-size cap as claimed in claim 12, wherein said single unfolded material is an elastic band.

14. The head wear as claimed in claim 12, wherein said gores are fabricated by a fabric in sheet structure.

15. The headwear as claimed in claim 14, wherein said fabric is cut in a bias direction.

16. A headwear comprising a main body having a plurality of panels forming a crown portion and a flexible seam connecting at least one of said plurality of panels to a neighboring one of said plurality of panels, wherein the crown portion includes a lower peripheral edge that is folded inwardly.

17. The headwear of claim 16, wherein the flexible seam is stretchable at least in a peripheral direction.

18. The headwear of claim 16, wherein the lower peripheral edge is double folded.

19. The headwear of claim 16, further comprising a visor connected to a portion of the crown and a sweat band attached to a lower peripheral edge of the crown along the portion at which the visor is connected.

20. The headwear of claim 16, further comprising a sweat band connected to a portion of a lower peripheral edge of the crown.

21. The headwear of claim 16, wherein the panels form gores that are uniaxially stretchable.

22. The headwear of claim 16, wherein the panels form gores that are woven.

23. The headwear as claimed in claim 16, wherein said gores are fabricated by a fabric in sheet structure.

24. The headwear as claimed in claim 23, wherein said fabric is cut in a bias direction.

* * * * *